US008556043B2

(12) United States Patent
Mangini et al.

(10) Patent No.: US 8,556,043 B2
(45) Date of Patent: Oct. 15, 2013

(54) PASSIVE DETECTION OF PERSONS IN ELEVATOR HOISTWAY

(75) Inventors: Richard J. Mangini, Brookfield, CT (US); Samuel R. Talbot, Marlborough, CT (US)

(73) Assignee: Otis Elevator Company, Farmington, CT (US)

( * ) Notice: Subject to any disclaimer, the term of this patent is extended or adjusted under 35 U.S.C. 154(b) by 330 days.

(21) Appl. No.: 12/745,266

(22) PCT Filed: Dec. 3, 2007

(86) PCT No.: PCT/US2007/024737

§ 371 (c)(1),
(2), (4) Date: May 28, 2010

(87) PCT Pub. No.: WO2009/073001

PCT Pub. Date: Jun. 11, 2009

(65) Prior Publication Data

US 2012/0018256 A1 Jan. 26, 2012

(51) Int. Cl.
*B66B 1/34* (2006.01)

(52) U.S. Cl.
USPC ..... 187/392; 187/279

(58) Field of Classification Search
USPC ..... 187/247, 313, 314, 316, 317, 380–388, 187/391–394, 279, 280; 340/545.1, 545.3, 340/545.6, 545.9, 565, 567
See application file for complete search history.

(56) References Cited

U.S. PATENT DOCUMENTS

| | | | | |
|---|---|---|---|---|
| 5,025,895 | A * | 6/1991 | Leone et al. | 187/277 |
| 5,283,400 | A | 2/1994 | Leone et al. | |
| 5,443,142 | A * | 8/1995 | Glaser | 187/316 |
| 5,644,111 | A * | 7/1997 | Cerny et al. | 187/393 |
| 5,703,367 | A | 12/1997 | Hashimoto et al. | |
| 6,050,369 | A | 4/2000 | Leone et al. | |
| 6,202,797 | B1 | 3/2001 | Skolnick et al. | |
| 6,223,861 | B1 * | 5/2001 | Sansevero | 187/316 |
| 6,467,585 | B1 | 10/2002 | Gozzo et al. | |
| 6,550,585 | B2 * | 4/2003 | Schoppa et al. | 187/391 |
| 6,603,398 | B2 | 8/2003 | Tinone et al. | |
| 6,945,363 | B2 | 9/2005 | Angst et al. | |
| 6,988,594 | B2 * | 1/2006 | Deplazes et al. | 187/393 |
| 7,350,625 | B2 * | 4/2008 | Deplazes et al. | 187/393 |
| 7,980,363 | B2 * | 7/2011 | Kattainen et al. | 187/391 |
| 2002/0117358 | A1 | 8/2002 | Schoppa et al. | |
| 2003/0094332 | A1 | 5/2003 | Tinone et al. | |
| 2011/0155510 | A1 * | 6/2011 | Lindberg | 187/314 |
| 2011/0303492 | A1 * | 12/2011 | Sonnenmoser et al. | 187/247 |

FOREIGN PATENT DOCUMENTS

| | | | |
|---|---|---|---|
| CN | 1642841 | A | 7/2005 |
| EP | 0716402 | A1 | 6/1996 |
| JP | 64088391 | | 4/1989 |
| JP | 7237838 | A | 9/1995 |

(Continued)

OTHER PUBLICATIONS

Japanese Patent Office, Office Action, Apr. 24, 2012, 4 pages.

(Continued)

*Primary Examiner* — Anthony Salata
(74) *Attorney, Agent, or Firm* — Kinney & Lange, P.A.

(57) ABSTRACT

Passive infrared detectors (20, 22, 24, 26, 28) carried by an elevator car (14) detect the presence of persons on top of or in the hoistway (12) below the elevator car (14). The passive infrared detectors (20, 22, 24, 26, 28) can also be used to detect open landing doors with no elevator present.

15 Claims, 4 Drawing Sheets

(56) References Cited

FOREIGN PATENT DOCUMENTS

| | | | |
|---|---|---|---|
| JP | 7301679 | A | 11/1995 |
| JP | 8161292 | A | 6/1996 |
| JP | 8198553 | A | 8/1996 |
| JP | 11035242 | A | 2/1999 |
| JP | 2001080835 | A | 3/2001 |
| JP | 200274766 | A | 9/2002 |
| JP | 2003321176 | A | 11/2003 |
| JP | 2004149273 | A | 5/2004 |
| JP | 2006044844 | A | 2/2006 |
| JP | 2006160485 | A | 6/2006 |
| JP | 2006323435 | A | 11/2006 |
| WO | 2007040538 | | 4/2007 |

OTHER PUBLICATIONS

PCT International Search Report and Written Opinion, Jul. 18, 2008, 7 pages.
State Intellectual Property Office, P.R. China, First Office Action, Oct. 10, 2012, 7 pages.
Japanese Patent Office, Office Action, Jan. 22, 2013, 3 pages.
State Intellectual Property Office, P.R. China, Decision on Rejection, Apr. 3, 2013, 17 pages.

* cited by examiner

PASSIVE DETECTION OF PERSONS IN ELEVATOR HOISTWAY

BACKGROUND

This invention relates to elevators, and in particular to systems and methods for detecting presence of a person on top of the elevator car, or a person in a hoistway above or below the car, or an open landing door with no elevator present at the landing.

Elevator safety systems have been developed to protect persons who may enter a hoistway and may be injured by movement of an elevator car within the hoistway. Elevator mechanics and building maintenance personnel may, on occasion, need to enter the hoistway either on top of an elevator car, or in the pit at the bottom of the hoistway.

When access to the top of the elevator car is required, a mechanic typically opens a hoistway door at the floor above the current location of the car and climbs onto the top of the car to perform an inspection, maintenance, or repair. An inspection switch is typically provided on the top of the car, so that the mechanic can prevent the car from making unexpected movements.

Access to the pit area is typically obtained by opening the hoistway doors at the lowest landing floor, while the elevator car is located at a higher floor in the hoistway. A pit emergency switch may be provided so that the mechanic entering the pit can disable movement of the elevator car downward into the pit while the mechanic is working in the pit.

Elevator safety systems must also take into account the potential for unauthorized persons gaining entrance to the hoistway. Elevator surfers have found ways to bypass safety installations and gain access to the hoistway of an elevator, so that they can ride on top of the elevator car as it travels up and down within the hoistway.

Elevator safety systems typically make use of a safety chain that includes hoistway door contacts on each hoistway door that are connected in series with the power supply and drive motor of the elevator. The top of car inspection switch and the pit emergency stop switch may also be connected in the safety chain. The opening of a single hoistway door contact will break a connection between the power supply and the drive motor, and prevent movement of the car as long as the hoistway door is open.

During a normal stop at a floor, the hoistway door and the elevator car doors will open for a short period of time to allow passengers to enter or exit the elevator car. The doors will then close again, and the safety chain is closed so that the car can move in the hoistway to its next stop.

If a hoistway door is opened manually when a car is not in position adjacent that hoistway door (i.e. an abnormal opening of the hoistway door has occurred), the safety system will prevent normal operation of the elevator until a latch condition caused by the abnormal opening is safely cleared. The safety system operates on an assumption that whenever an abnormal opening of a hoistway door occurs, a person or persons could have entered the elevator hoistway. To prevent possible injury of authorized or unauthorized personnel that may have entered the hoistway while the hoistway door was open, the elevator system enters a shutdown condition that prevents elevator motion until a special sequence is followed. In the past, when a safety shutdown condition has occurred, a resetting of the elevator system to normal operation has required a manual reset by service personnel. Requirement of a manual reset by service personnel ensures that the elevator system is safe, with no personnel located in the hoistway, before operation resumes. It does, however, result in increased service costs. In addition, in some buildings, disabling the elevator until an onsite reset by service personnel can be performed is inconvenient and problematic. For example, losing the use of an elevator in a hospital for an extended period of time can be a problem when patients need to be moved from floor to floor.

Not every opening of a hoistway door results in persons remaining within the hoistway. For example, elevator inspectors may open a hoistway door briefly as part of the normal inspection. This opening of hoistway door by an inspector can generate a shutdown condition that requires a mechanic to visit the site to verify that there is no one in the hoistway and that normal elevator operation is safe to resume.

Examples of systems using elevator hoistway safety chains are described in U.S. Pat. No. 6,223,861 by Frank M. Sansevero entitled "Elevator Hoistway Access Safety"; U.S. Pat. No. 6,603,398 by Helio Tinone and Frank W. Adams entitled "Hoistway Access Detection System"; U.S. Pat. No. 6,467,585 by Michael Gozzo, Robert G. Morgan and Alberto Vecchiotti entitled "Wireless Safety Chain For Elevator System"; and U.S. Pat. No. 6,550,585 by Wolfgang M. Schoppa and Axel Steffen Gerwing entitled "Hoistway Intrusion Detection". All of these patents are assigned to Otis Elevator Company. The Sansevero U.S. Pat. No. 6,223,861 allows the elevator car to move at an inspection speed when an opening of a hoistway door occurs unaccompanied by opening of a car door. The Tinone et al. U.S. Pat. No. 6,603,398 describes a hoistway access detection system using multiple safety chains. The Gozzo et al. U.S. Pat. No. 6,467,585 uses wireless transceivers associated with safety chain components to provide a wireless safety chain.

The Schoppa et al. U.S. Pat. No. 6,550,585 describes a safety system for elevators that includes motion sensors to detect movement of persons within the hoistway. When a safety shutdown has occurred as a result of an abnormal opening of a hoistway door, the safety control system will automatically reset the elevator to a normal operating state if the shaft monitoring device does not detect persons in the elevator hoistway during a predetermined period, such as 5 to 10 minutes. The shaft monitoring device may include an ultrasound or infrared motion sensor, video cameras connected to an image analyzer, or a load sensitive mat provided on top the car or in the hoistway pit.

U.S. Pat. No. 5,283,400 by Richard J. Leone, Robert F. Cummins, Joseph Vitiello, and Thomas Brochhagan entitled "Elevator Shaftway Intrusion Device" also describes an intrusion detector mounted on an elevator cab to detect unauthorized access to the top of elevator cars. The intrusion detector senses disturbance of an energy field by an intruder entering a zone of detection. The energy field may be electromagnetic energy within an infrared, radio frequency, or microwave frequency bands, or sonic energy in an ultrasonic frequency band.

U.S. Pat. No. 6,202,797 by Steven M. Skolnick, Chester J. Slabinski, and Frank M. Sansevero entitled "Automatic Protection of Elevator Mechanics" and assigned to Otis Elevator Company describes a safety system in which an elevator mechanic wears a portable device such as a transmitter when in the hoistway pit or on top of a car. Sensing devices on the top and bottom of the car are activated by the portable device to cause an emergency stop and to warn the mechanic.

SUMMARY

Potentially unsafe conditions within an elevator hoistway are detected by a system that includes a passive infrared detector and a local processor that produces an output based upon signals from the infrared detector. The passive infrared detector can be positioned, for example, on top or below the elevator car, or in a pit area of the hoistway.

In another aspect, the invention includes passive infrared detectors positioned to sense infrared radiation from above and below the elevator car. A controller in communication with the passive infrared detectors controls operation of the elevator car as a function of signals from the passive infrared detectors indicating presence of a person in the hoistway, presence of an open landing door, or presence of a person at an open landing door.

DETAILED DESCRIPTION

Figure 1:
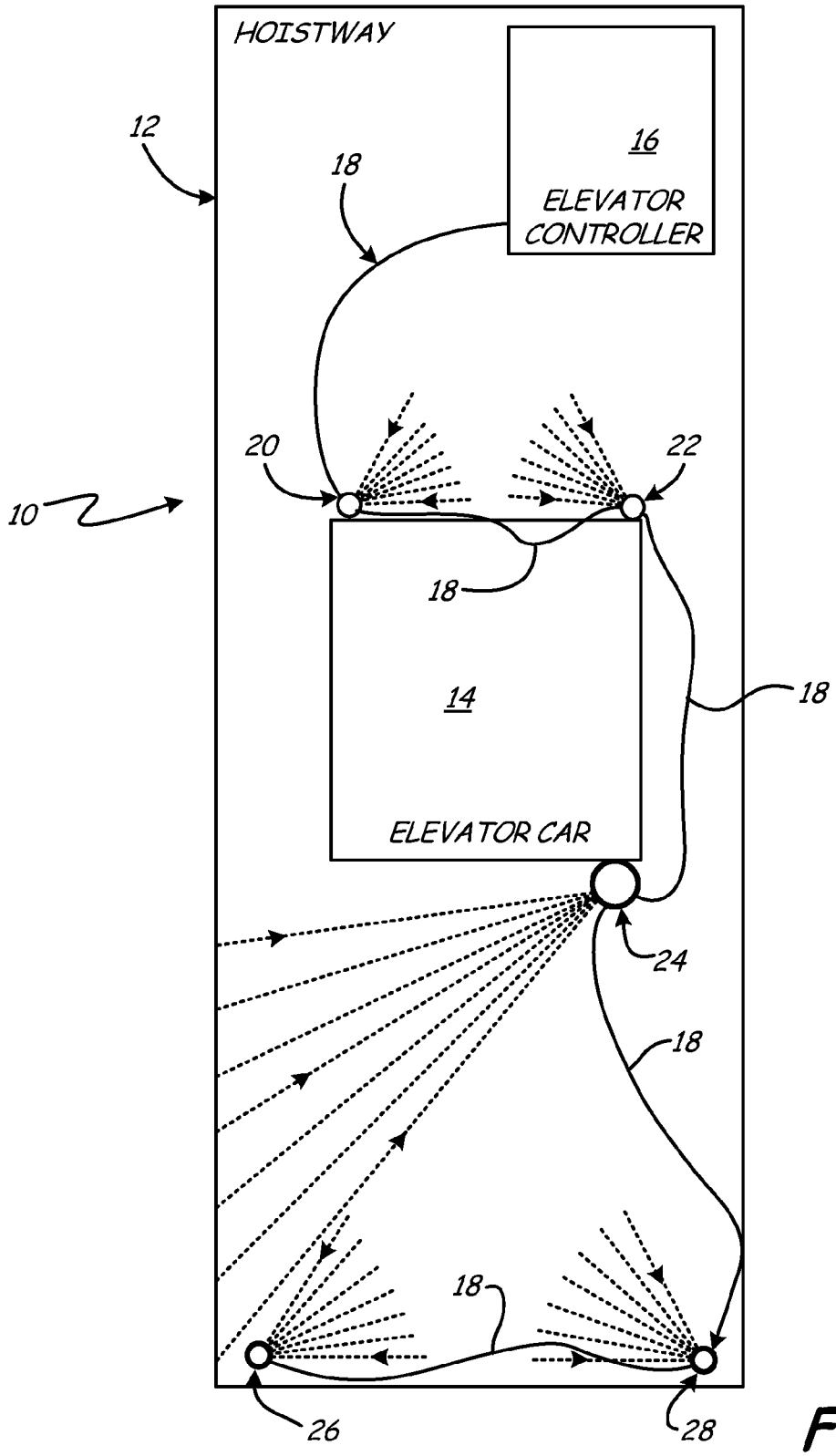
FIG. 1 shows a schematic diagram of an elevator system including the passive infrared detector system for detecting presence of persons and open hoistway doors.

FIG. 1 is a schematic diagram of elevator system 10, which uses passive infrared detection to detect presence of persons within elevator hoistway 12, and to detect presence of open hoistway doors. Elevator system 10 includes elevator hoistway 12, elevator cab 14, elevator controller 16, communication bus 18, top of car (TOC) passive infrared detectors 20 and 22, bottom of car (BOC) passive infrared detector 24, and pit area passive infrared detectors 26 and 28.

Elevator controller 16 controls motion of elevator cab 14 within hoistway 12. Elevator controller 16 is responsive to all call signals generated by users pressing buttons at the landings on various floors, as well as inputs selecting particular floors that are provided through the elevator control panel within elevator cab 14. Elevator controller 16 also forms a part of an elevator hoistway safety chain that prevents normal operation of elevator system 10 until a latched condition (caused by an abnormal opening of an elevator hoistway door), has been safely cleared. The safety chain operates on the assumption that if an abnormal opening of a hoistway door has occurred, a person or persons could have entered elevator hoistway 12. To prevent possible injury to persons that may have entered hoistway 12 via an open hoistway door, elevator controller 16 enters a shutdown condition that prevents motion of elevator cab 14 unless a special sequence is followed.

Elevator controller 16 is connected through communication bus 18 with passive infrared detectors 20, 22, 24, 26 and 28. Detectors 20-28 are used to verify the presence or absence of personnel that have been presumed to be in hoistway 12. Based upon data received from detectors 20-28, elevator control 16 can verify whether there is any person located with in hoistway 12 and, if not, can reset the safety chain to allow for normal or special elevator operation as appropriate.

In the embodiment shown in FIG. 1, each of detectors 20-28 is a passive infrared detector that includes an embedded local microprocessor communicating with elevator controller 16 over communication bus 18. The local microprocessors process data received from infrared sensors, and pass data through a low speed communication data channel (for example EIT/TIA422/485) through communication bus 18 to elevator controller 16. The data is then used by elevator controller 16 to decide whether a latch shutdown condition (caused, for example, by detection of an abnormal opening of a hoistway door), can be safely cleared by resetting the latched shutdown condition so that normal operation of elevator system 10 can resume. Other shutdown conditions where the initial shutdown cause no longer exists can also utilize the detection system formed by detectors 20-28 to reset the shutdown condition if hoistway 12 is clear of personnel.

TOC detectors 20 and 22 are located on top of elevator cab 14, and detect the presence of personnel on top of cab 14 or in the hoistway above cab 14. BOC detector 24 is mounted on the bottom of cab 14, and will detect presence of personnel below cab 18. Detectors 26 and 28 are located in the elevator pit area at the bottom of hoistway 12, and detect presence of persons located in the pit area.

TOC detectors 20, 22 and BOC detector 24 can also detect the presence of infrared radiation present at an open landing caused be either ambient light or landing illumination while elevator cab 14 is moved toward the open landing door. In the diagram illustrated in FIG. 1, hoistway landing doors are located along the left hand side of the rectangle representing elevator hoistway 12.

TOC detector 22 can detect radiation from an open landing door in hoistway 12 above elevator cab 14 while cab 14 moves upward toward the landing opening. BOC detector 24 can detect radiation from an open landing door in hoistway 12 below elevator cab 14 while cab 14 moves down toward the landing opening.

Personnel present in the landing area can also be detected by TOC detector 22 or BOC detector 24 because the infrared profile emitted by a person can be discriminated from the typical background infrared profile from inanimate objects. The local microprocessor associated with TOC detector 22 or BOC detector 24 has stored reference infrared profiles for typical open landing door areas associated with elevator hoistway 12. Deviations from this profile can be noted because human beings dissipate a great portion of heat from the head due to the amount of blood flow in the scalp area. The resultant peaks in the passive infrared profile are indicative of heads of personnel.

TOC detector 22 and BOC detector 24 can detect open landing doors with no elevator present at the landing, so that appropriate parties can be informed as to the exact location of the unsafe condition or conditions. This results in the ability to operate elevator system 10 safely while avoiding open landing areas, or by positioning elevator cab 14 to block an open landing area.

If personnel are detected at an open landing area, they can be alerted via audio components on elevator cab 14, or by components at the hall call buttons. Elevator controller 16 can cause a message to be provided through the audio components instructing personnel to stay clear of the open area during remote rescue operations or while elevator cab 14 is being positioned to block the open landing area.

In elevator system 10, detectors 20-28 are used not only to detect persons who are in motion, but also persons who are not presently moving because they are disabled, or because they are trying to avoid detection. Each detector 20-28 has associated signal processing circuitry and a microprocessor to examine the signal output from the infrared sensor and to determine the presence of one or more persons as indicated by peaks in the detected passive infrared profile. For example, since human beings dissipate a great portion of heat from the head, peaks in the passive infrared profile can be indicative of the heads of persons.

Figure 2:
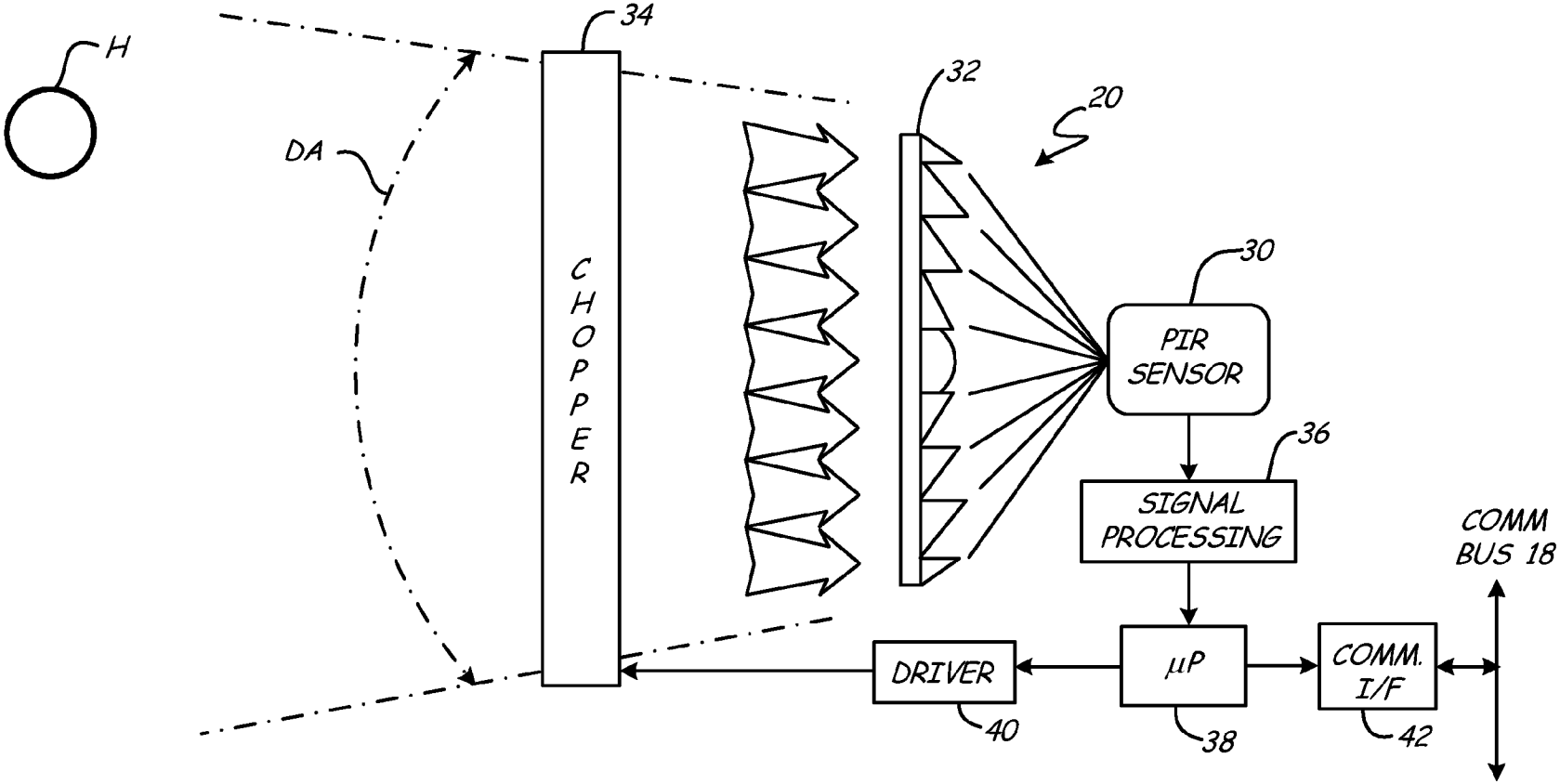
FIG. 2 is a diagram showing a passive infrared detector assembly.

FIG. 2 is a block diagram of TOC detector 20, which is typical of each of the passive infrared detectors 20-28 used in system 10 FIG. 1. TOC detector 20 includes passive infrared (PIR) sensor 30, Fresnel lens 32, chopper 34, signal processing circuitry 36, microprocessor 38, chopper driver 40, and communication interface 42. PIR sensor 30 may be, for example, a pyroelectric sensor (which may be a single sensor element or an array of sensor elements). A pyroelectric sensor requires a change of heat in order to produce an output. As a result, a means of chopping or scanning an area being detected is necessary in order to obtain an output signal from a pyroelectric sensor. The chopping or scanning can be accomplished via mechanical, electro-optical, or electronic means. In the embodiment shown in FIG. 2, chopper 32 provides a changing infrared radiation input required for operation of the pyroelectric sensor. Chopper 34 may be, for example, an electro-optical switch window, or an electromechanical shutter. Chopper 34 is controlled by microprocessor 38 through driver 40.

In other embodiments, other forms of infrared sensors can be used in PIR sensor 30. For example, thermopiles may be used instead of or in addition to pyroelectric sensors to yield a system that can be tuned to respond to thermal radiation from a human body whether in a non-moving or moving state. Thermopile arrays do not require a change in signal for an output response, and therefore chopper 34 may not be needed if PIR sensor 30 uses only thermopiles as infrared sensors.

Fresnel lens 32 is preferably a plastic lens that is utilized to focus thermal radiation onto PIR sensor 30. Lens 32 passes infrared radiation in the 8 micron to 14 micron wavelength range, which is the range most sensitive to human body radiation. The bodies of animals and humans generate infrared radiation that peaks at a wavelength of about 9.4 microns. An infrared filter may also be installed over the sensor area of PIR sensor 30 to filter out ambient light and heat sources, and to provide peak response in the 8 to 14 micron wavelength range.

In FIG. 2, human body H is shown within detection area DA of PIR detector 20. Presence of body H within detection area DA is sensed whether body H is moving, or whether it is stationary within detection area DA.

As illustrated in FIG. 1, detectors 20-28 can be arranged so that multiple detectors have overlapping detection areas. This adds a degree of redundancy to the personnel detection system.

Minimization of false detection can be accomplished by taking a calibration scan of the entire elevator path. Data associated with hot non-living heat sources can be stored in memory associated with the local microprocessor for each detector, or in a central memory device associated with elevator controller 16. The data from non-living heat sources may be due to steady state or transient heat sources. Transient sources may be periodic, and can be accounted for in the calibration data base. Non-repeatable transient sources can be discriminated via heat profile temperature or shape. False detection is also minimized by tuning the sensitivity of detectors 20-28 to the human body's infrared emissivity (i.e. within the 8 micron to 14 micron wavelength range). The calibration detection data can be used by the local microprocessors or by elevator controller 16 to compare against data taken during a personnel detection interval in order to increase the reliability of detection.

Further signal discrimination can be realized by activating the detectors upon the absence or presence of one or more discrete events. For example, when elevator cab 14 is in motion, there may be no need to detect personnel presence, because the latched shutdown condition (which inhibits elevator cab motion) is not present if elevator cab 14 is moving. However, a more comprehensive approach may be to activate detectors 20-28 for personnel detection whenever elevator demand is present. This would ensure that no personnel were present within hoistway 12 before allowing elevator motion. It would also add a degree of safety checks that could prevent accidents caused by unauthorized personnel access in the elevator hoistway. Elevator controller 16 can, in some embodiments, selectively activate detectors 20-28 through commands provided over communication bus 18.

The personnel detection feature of system 10 can also be utilized in cases where a mechanic has entered hoistway 12 and has bypassed the safety chain to perform tasks or maintenance. For example, elevator cab 14 approaching a radiant infrared source in the appropriate wavelength range could be utilized to cause elevator controller 16 to apply the braking system regardless of a bypassed safety chain.

Figure 3A:
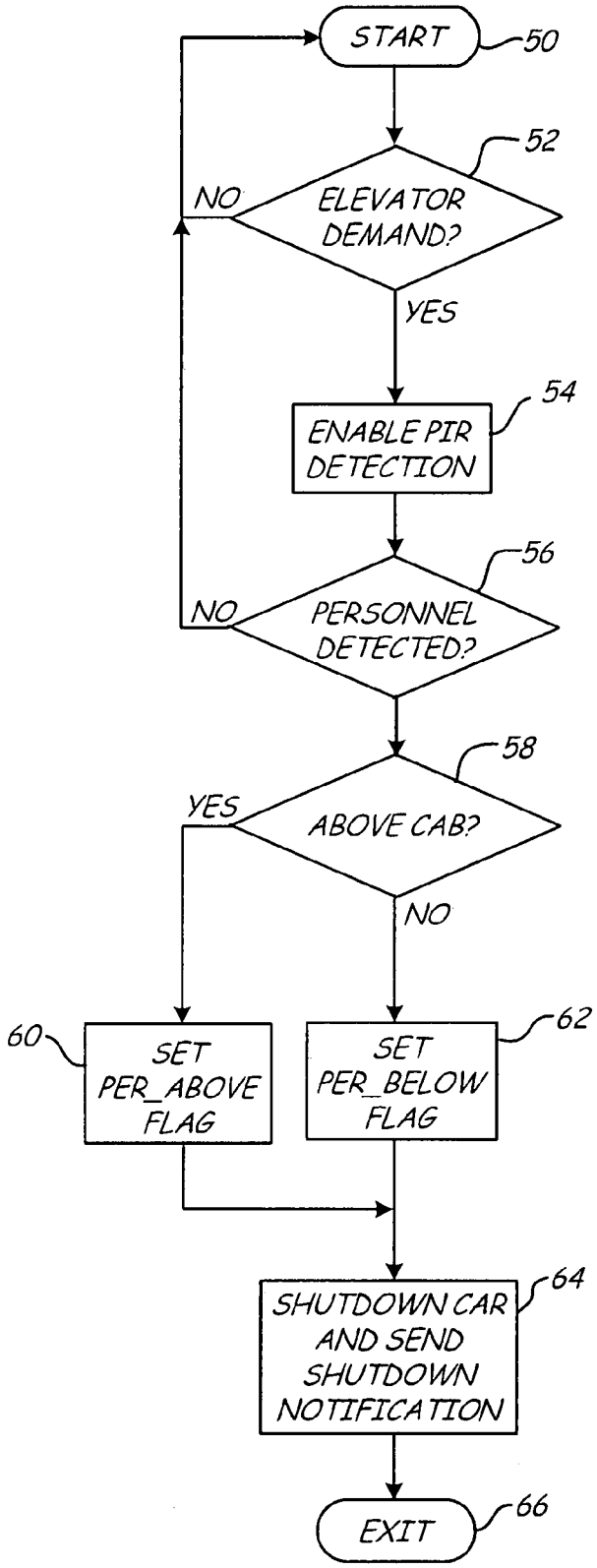
FIGS. 3A and 3B are flow diagrams illustrating a normal mode operation and shutdown operation of the elevator system of FIG. 1.
Figure 3B:
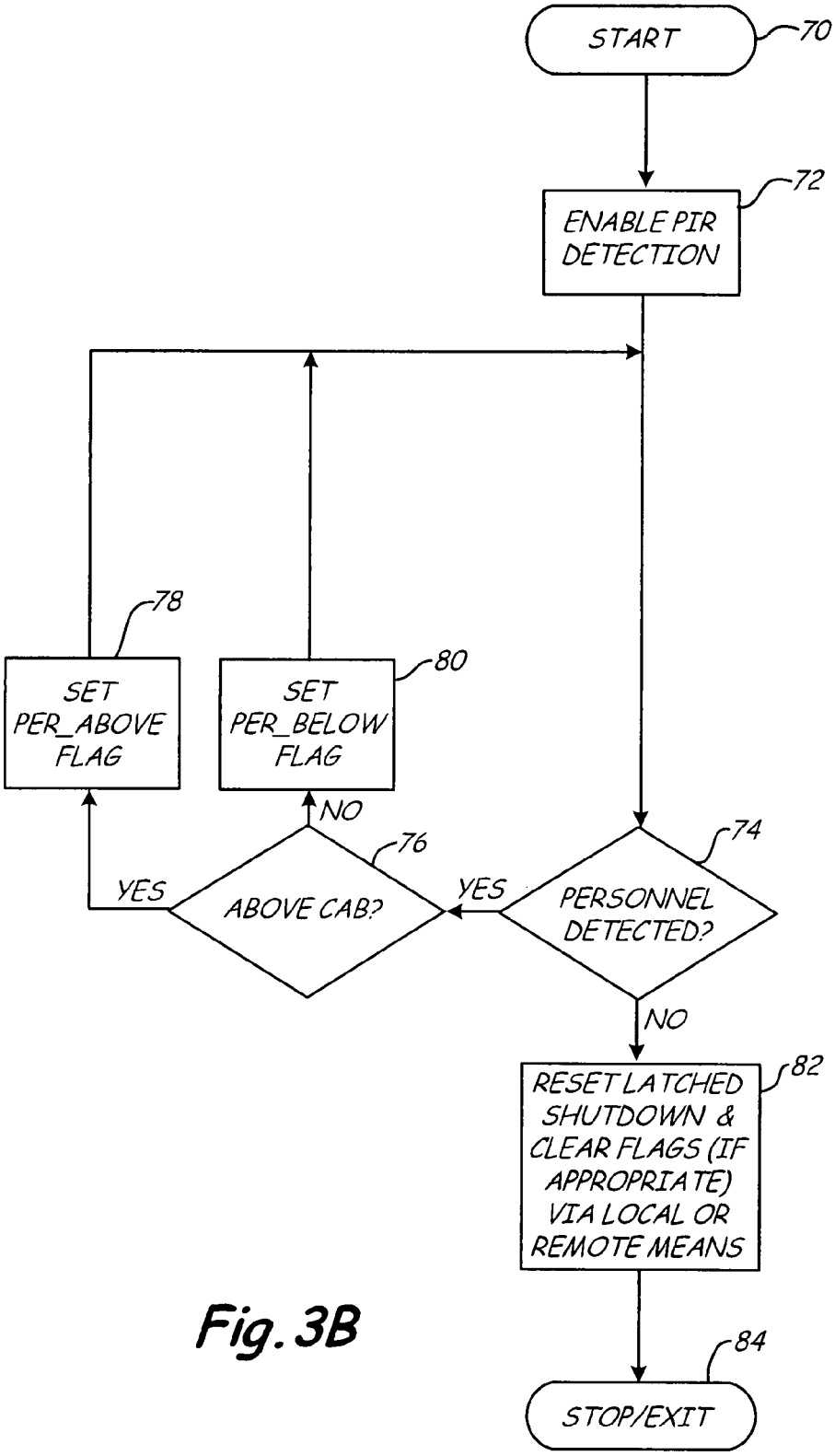

FIGS. 3A and 3B are flow charts illustrating operation of system 10. FIG. 3A illustrates normal mode operation, while FIG. 3B illustrates shutdown operation.

In FIG. 3A, normal mode operation of elevator controller 16 begins at start 50. Elevator controller 16 then determines whether elevator demand exists (step 52). If there is no elevator demand, controller 16 returns to start 50. If elevator demand is present, elevator controller 16 enables PIR detection by sending a message to detectors 20-28 over communication bus 18 (step 54). Based upon data returned to elevator controller 16 over communication bus 18, elevator controller 16 determines whether personnel have been detected (step 56). If no personnel have been detected, controller 16 returns to start 50.

Elevator controller 16 then determines, based on data returned by detectors 20-28, whether the detected personnel are located above or below elevator cab 14 (step 58). If data from BOC detector 20 or TOC detector 22, or both, indicates presence of personnel, elevator controller 16 sets a person above flag (step 60). If detection of personnel is indicated by data from BOC detector 24 or from pit detectors 26 and 28, elevator controller 16 sets the person below flag (step 62).

If a person above or person below flag has been set, elevator controller 16 shuts down elevator cab 14 and sends a shutdown notification (step 64). Controller 16 then exits normal mode operation (step 66) and uses shutdown operation mode (shown in FIG. 3B) to verify continued presence of personnel.

As shown in FIG. 3B, the shutdown operation mode is started at step 70. Elevator controller 16 then enables PIR detection by sending messages to sensors 20-28 over communication bus 18 (step 72).

Based upon the data returned to elevator controller 16 from detectors 20-28, elevator controller 16 determines whether personnel have been detected (step 74). If personnel have been detected, elevator controller 16 determines whether the personnel have been detected above or below elevator cab 14 (step 76), and sets either a person above flag (step 78) or a person below flag (step 80).

Elevator controller 16 then continues to monitor the data from detectors 20-28 to determine whether personnel continue to be detected (step 74). When data from sensors 20-28 indicates that no personnel are detected, elevator controller 16 resets latched shutdown and clears flags, so that system 10 can return to normal operation (step 82). Elevator controller 16 then stops the shutdown operation and exits the shutdown operation mode (step 84). Elevator controller 16 then returns to the normal operation mode shown in FIG. 3A.

An elevator system with a passive infrared detector system to detect presence of personnel within a hoistway and the presence of open hoistway doors provides a number of benefits. First, it allows detection of the presence of a person or persons on the top of an elevator cab, or in a hoistway above or below the cab, such as in the hoistway pit. This information can then be used to take appropriate action by the elevator controller to ensure that elevator motion is controlled in a manner commensurate with the safety of the person or persons detected.

Second, the system provides a way to ensure that no personnel are present in the hoistway in the vicinity of the elevator cab after the occurrence of an unauthorized opening of the hoistway access door. As a result, a latched shutdown condition caused by detection of an unauthorized access to the hoistway can be cleared by resetting, rather than by requiring a service call to the elevator site.

Third, the system can detect open landing doors with no elevator present at the landing. This allows appropriate parties to be informed as to the exact location of this unsafe condition.

Fourth, the system can detect which landings have open landing doors, so that the elevator may be operated safely while avoiding the open landing areas.

Fifth, the system can be used to detect open landing doors, so that the elevator controller can position the elevator cab to block an open landing area.

Sixth, the system can be used to detect which landings have open doors, so that personnel present in the area of the open landing can be alerted by audio components on the elevator or in the landing area to stay clear of the open door area during remote rescue operations.

Although the present invention has been described with reference to preferred embodiments, workers skilled in the art will recognize that changes may be made in form and detail without departing from the spirit and scope of the invention.

The invention claimed is:

1. A system for detecting presence of a person within an elevator hoistway, the system comprising:

a passive infrared detector positioned to sense infrared radiation from within the elevator hoistway; and a local processor associated with the passive infrared detector for producing an output indicating presence of a person in the elevator hoistway based upon signals from the passive infrared detector representing a sensed infrared profile, wherein the local processor produces the output by comparing the sensed infrared profile produced by signals from the passive infrared detector with a stored reference infrared profile to determine whether a person is present in the elevator hoistway.

2. The system of claim 1, wherein the passive infrared detector comprises:

a lens for receiving infrared radiation from a field of view; and an infrared sensor for receiving infrared radiation from the lens.

3. The system of claim 2, wherein the infrared sensor comprises a pyroelectric sensor, and wherein the passive infrared detector further includes:

a chopper for periodically interrupting infrared radiation to the pyroelectric sensor.

4. The system of claim 1, wherein the passive infrared detector is positioned to receive infrared radiation caused by ambient light or landing illumination from an open landing door.

5. The system of claim 4, wherein the local processor compares an infrared profile produced by signals from the passive infrared detector with a stored reference infrared profile to determine presence of an open landing door.

6. The system of claim 1, wherein the passive infrared detector is positioned to sense infrared radiation from a person on top of an elevator car.

7. The system of claim 1, wherein the passive infrared detector is positioned to sense infrared radiation from a person in the hoistway below an elevator car.

8. The system of claim 7, wherein the passive infrared detector is mounted below and is movable with the elevator car.

9. The system of claim 7, wherein the passive infrared detector is mounted in a pit area of the hoistway.

10. The system of claim 1, wherein the local processor communicates over a communication medium with an elevator controller that controls movement of an elevator car in the hoistway.

11. A system for controlling operation of an elevator car in an elevator hoistway, the system comprising:

a plurality of passive infrared detectors positioned to sense infrared detectors positioned to sense infrared radiation above and below the elevator car; and a controller that controls motion of the elevator car in the elevator hoistway and forms a part of an elevator safety chain that prevents normal operation of the elevator car until a latched shutdown condition has been safely cleared, the controller being in communication with the passive infrared detectors to receive signals from the passive infrared detectors indicating at least one of presence of a person in the hoistway, presence of an open landing door, and presence of a person at an open landing door, wherein during a latched shutdown condition if the signals from the passive infrared detectors do not indicate presence of a person, the controller resets the latched shutdown condition and resumes normal operation of the elevator car.

12. The system of claim 11, wherein the controller activates the passive infrared sensors when the elevator car is stopped.

13. The system of claim 11, wherein the controller causes the elevator car to block an open landing door in response to a signal from one of the passive infrared detectors indicating presence of an open landing door.

14. The system of claim 11, wherein the controller inhibits movement of the elevator car when a signal from one of the passive infrared detectors indicates presence of a person in the hoistway.

15. A method of operating an elevator system comprising:

sensing infrared radiation with passive infrared detectors on top of an elevator car, and on bottom of the elevator car; and detecting presence of an open landing door at which no car is present based upon infrared radiation, sensed by the passive infrared detectors, that is caused by ambient light or landing illumination present at the open landing door.

* * * * *